US009761156B2

(12) United States Patent
Bowers et al.

(10) Patent No.: US 9,761,156 B2
(45) Date of Patent: Sep. 12, 2017

(54) SYSTEMS AND METHODS FOR A BOW LABEL FOR A BEVERAGE CONTAINER

(71) Applicant: THE COCA-COLA COMPANY, Atlanta, GA (US)

(72) Inventors: Christopher James Bowers, South Buckinghamshire (GB); Gregory Steven Bentley, Brussels (BE)

(73) Assignee: THE COCA-COLA COMPANY, Atlanta, GA (US)

( * ) Notice: Subject to any disclaimer, the term of this patent is extended or adjusted under 35 U.S.C. 154(b) by 0 days.

(21) Appl. No.: 15/308,466

(22) PCT Filed: May 6, 2015

(86) PCT No.: PCT/US2015/029358

§ 371 (c)(1),
(2) Date: Nov. 2, 2016

(87) PCT Pub. No.: WO2015/171686

PCT Pub. Date: Nov. 12, 2015

(65) Prior Publication Data

US 2017/0053567 A1 Feb. 23, 2017

Related U.S. Application Data

(60) Provisional application No. 61/990,304, filed on May 8, 2014.

(51) Int. Cl.

| | |
|---|---|
| ***G09F 3/00*** | (2006.01) |
| ***G09F 3/02*** | (2006.01) |
| ***G09F 3/10*** | (2006.01) |

(52) U.S. Cl.

CPC ..... *G09F 3/0289* (2013.01); *G09F 3/02* (2013.01); *G09F 3/10* (2013.01);

(Continued)

(58) Field of Classification Search

CPC ..... G09F 2003/0273; G09F 3/10; G09F 2023/0025

(Continued)

(56) References Cited

U.S. PATENT DOCUMENTS 4,585,676 A * 4/1986 DeSmet ..... D04D 7/105 156/70
4,684,552 A * 8/1987 LaBrosse ..... D04D 7/105 223/46

(Continued)

FOREIGN PATENT DOCUMENTS

JP H08278752 A 10/1996

OTHER PUBLICATIONS

International Search Report and Written Opinion for International Application No. PCT/US2015/029358 mailed Aug. 3, 2015.

*Primary Examiner* — Shin Kim
(74) *Attorney, Agent, or Firm* — Eversheds Sutherland (US) LLP

(57) ABSTRACT

A bow label for a beverage container is disclosed herein. The bow label may include a first sheet at least partially attached to the beverage container. The bow label also may include a second sheet at least partially attached to the first sheet. The first sheet and the second sheet may include a first configuration and a second configuration. In addition, the bow label may include a pull cord disposed between and at least partially attached to the first sheet and the second sheet. In this manner, movement of the pull cord may move the first sheet and the second sheet between the first configuration and the second configuration. In some instances, the second configuration may include a bow-like shape.

19 Claims, 9 Drawing Sheets

(52) U.S. Cl.
CPC ..... *G09F 2003/0222* (2013.01); *G09F 2003/0251* (2013.01); *G09F 2003/0272* (2013.01)

(58) Field of Classification Search
USPC ..... 428/4, 5; 40/310
See application file for complete search history.

(56) References Cited

U.S. PATENT DOCUMENTS 4,724,175 A * 2/1988 LaBrosse ..... D04D 7/105 156/70
4,822,648 A * 4/1989 Cheng ..... D04D 7/105 223/46
5,114,761 A * 5/1992 Doherty ..... D04D 7/105 156/70
5,387,446 A * 2/1995 Weder ..... D04D 7/105 156/70
5,614,274 A * 3/1997 Huss ..... D04D 11/00 223/46
5,679,416 A * 10/1997 Cheng ..... D04D 7/105 223/46
5,693,381 A * 12/1997 Cheng ..... D04D 7/105 223/46
6,941,689 B1 9/2005 Seidl
8,065,827 B2 * 11/2011 Regas ..... B65D 23/085 40/310
8,304,073 B2 * 11/2012 Davies ..... C09J 7/0296 156/701
8,429,839 B2 * 4/2013 Regas ..... B65D 23/085 40/310
2005/0229450 A1 * 10/2005 Larsen ..... A47G 19/2227 40/310
2009/0100726 A1 * 4/2009 Regas ..... B65D 23/085 40/310
2011/0086187 A1 * 4/2011 Lin ..... D04D 7/105 428/5
2012/0298544 A1 11/2012 Capdevila Pons
2013/0068380 A1 3/2013 Brookshire et al.
2013/0232838 A1 * 9/2013 Regas ..... B65D 23/085 40/672
2015/0235575 A1 * 8/2015 Balogh ..... G09F 3/02 206/459.5
2017/0053567 A1 * 2/2017 Bowers ..... G09F 3/0289

* cited by examiner

SYSTEMS AND METHODS FOR A BOW LABEL FOR A BEVERAGE CONTAINER

CROSS-REFERENCE TO RELATED APPLICATIONS

The disclosure claims priority to and the benefit of U.S. provisional patent application No. 61/990,304, filed 8 May 2014, which is herein incorporated by reference in its entirety.

FIELD

The disclosure generally relates to a label and more particularly relates to systems and methods for a bow label for a beverage container.

BACKGROUND

Beverage containers may be used to store, transport, and/or dispense a beverage. In some instances, beverage containers may include one or more labels. The labels may include indicia, such as trademarks, advertisements, or the like. In some instances, the labels may be wrapped around the beverage containers. In other instances, the labels may be removed from the beverage containers. Typical labels convey information and provide limited interaction with a consumer.

SUMMARY

Some or all of the above needs and/or problems may be addressed by certain embodiments of a bow label for a beverage container disclosed herein. According to an example embodiment, the bow label may include a first sheet at least partially attached to the beverage container. The bow label also may include a second sheet at least partially attached to the first sheet. The first sheet and the second sheet may include a first configuration and a second configuration. In addition, the bow label may include a pull cord disposed between and at least partially attached to the first sheet and the second sheet. In this manner, movement of the pull cord may move the first sheet and the second sheet between the first configuration and the second configuration. In some instances, the second configuration may include a bow-like shape.

BRIEF DESCRIPTION OF THE DRAWINGS

The detailed description is set forth with reference to the accompanying drawings, which are not necessarily drawn to scale. The use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

Figure 1:
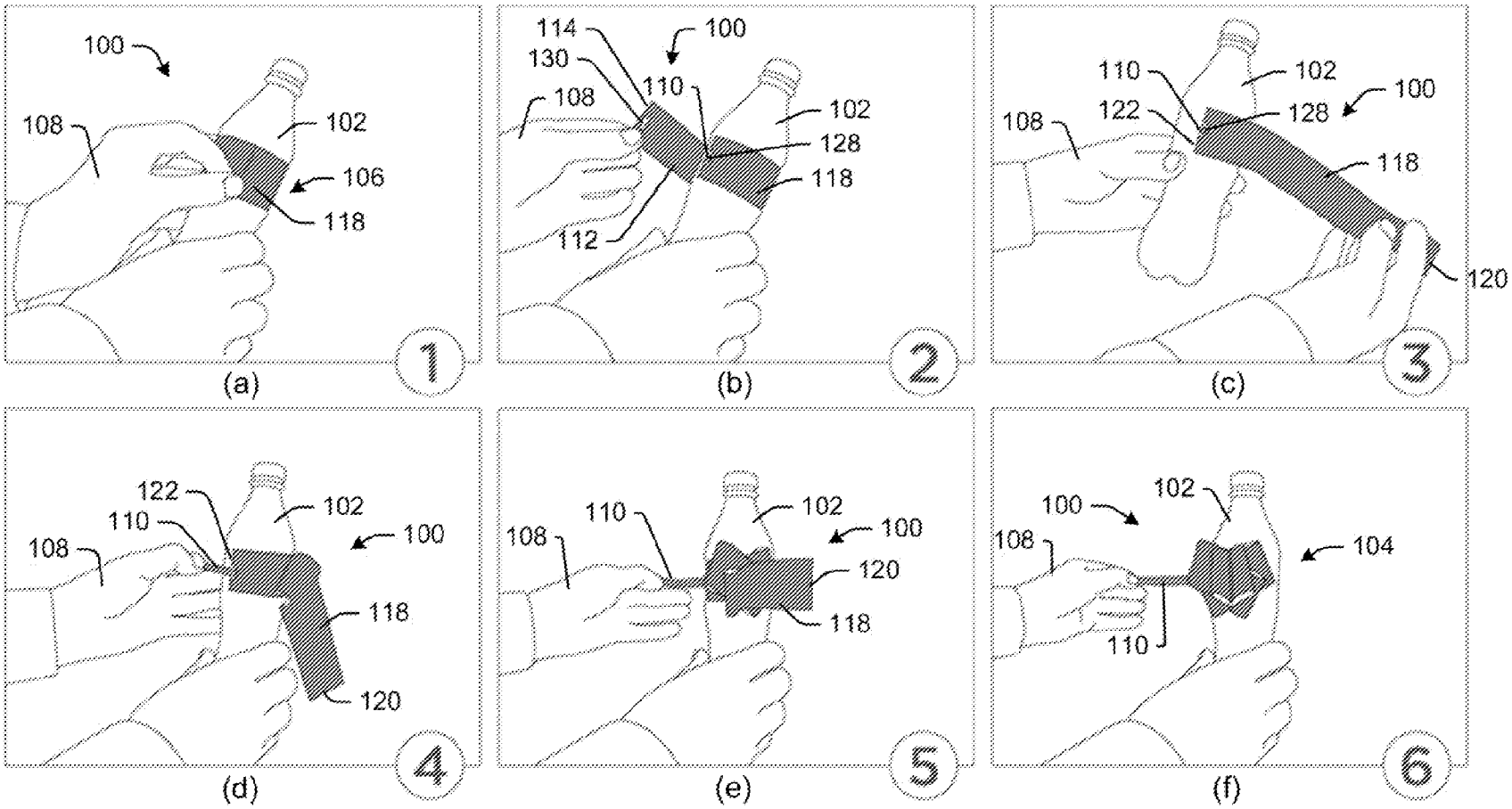
FIG. 1 schematically depicts an example method for a bow label assembly in accordance with one or more embodiments of the disclosure.

A bow label for a beverage container is disclosed herein. The beverage container may include a bottle, a can, a jug, or the like. Any container capable of storing, transporting, and/or dispensing a beverage may be used herein. The beverage container may be sized and shaped to enable a user to consume a beverage therefrom, or the beverage container may be configured to transport and dispense a beverage into other containers. Any beverage container may be used herein.

In some instances, the bow label may form a label about the beverage container. The label may include indicia, such as trademarks, advertisements, or the like. The label may include any markings thereon. In other instances, the bow label may form a bow about the beverage container. For example, the bow label may initially take the form of a typical label that is wrapped around the beverage container. The bow label, however, may be manipulated by a user to form a bow about the beverage container. For example, a user may unwrap a portion of the bow label from the beverage container to expose a pull cord. The user may then pull on the pull cord to transform the bow label into a bow. Although described as a bow, the pull cord may be pulled to transform the bow label into any shape. For example, the bow-like shape may include a heart shape, a flower shape, hands, or a contoured bottle shape. In addition, the bow-like shape may transform fragmented images or markings on the label into a formed shape, image, or text message.

According to an example embodiment, the bow label may include a first sheet having a first end and a second end. The first sheet may be at least partially attached to the beverage container. The bow label also may include a second sheet having a first end and a second end. The second sheet may be at least partially attached to the first sheet. The first sheet and the second sheet may include a first configuration and a second configuration. In addition, the bow label may include a pull cord disposed between and at least partially attached to the first end of the first sheet and the first end of the second sheet. In this manner, movement of the pull cord may move the first sheet and the second sheet between the first configuration and the second configuration. In some instances, the second configuration may include a bow-like shape.

The first sheet may be at least partially attached to the second sheet by one or more adhesive strips. The one or more adhesive strips may be arranged in a pattern to form the bow-like shape in the second configuration. That is, the first sheet and the second sheet may be adhered together by the one or more adhesive strips and folded about the one or more adhesive strips to form the bow-like shape in the second configuration when the pull cord is pulled.

In certain embodiments, the bow label may include an access tab disposed about the second end of the second sheet. The access tab may provide access to the pull cord. In some instances, the access tab may include a removable flap or the like. For example, the second end of the second sheet may include one or more perforations that may enable the flap to be removed from the second sheet (or folded out-of-the-way) to expose at least a portion of the pull cord.

In some instances, the first sheet and the second sheet may be wrapped around the beverage container in the first configuration. For example, the second end of the first sheet may be at least partially attached to the beverage container with an adhesive or the like. In addition, the first end of the first sheet may be wrapped around the beverage container and at least partially attached to the second end of the second sheet by an adhesive or the like. In this manner, the bow label may be wrapped around the beverage container in the first configuration. The first configuration may include any arrangement before the pull cord is pulled, and the bow is formed. That is, the first configuration may include a partially unwrapped arrangement.

In certain embodiments, a first strip of perforations may be disposed about the first sheet and the second sheet. The first strip of perforations may define a first portion of the first sheet that is at least partially attached to the beverage container. Likewise, a second strip of perforations may be disposed about the first sheet and the second sheet. The second strip of perforations may define a second portion of the first sheet that is at least partially attached to the beverage container. The first sheet and the second sheet may be torn about the first strip of perforations and/or the second strip of perforations to form the bow. In other instances, the first strip of perforations and/or the second strip of perforations may be omitted.

In use, a user may remove the first end of the first sheet from the second end of the second sheet to unwrap the bow label from around the beverage container. In some instances, if present, the first strip of perforations and/or the second strip of perforations may be torn to form a middle portion of the bow label. In unwrapping the bow label, the access tab may be opened and a portion of the pull cord exposed. The user may then pull the pull cord to fold the first sheet and the second sheet (or the middle portion of the first sheet and the second sheet) about the one or more adhesive strips to form the bow-like shape. The bow-like shape may be any decorative shape or the like.

These and other embodiments of the disclosure will be described in more detail through reference to the accompanying drawings in the detailed description that follows. This brief introduction, including section titles and corresponding summaries, is provided for the reader's convenience and is not intended to limit the scope of the claims, nor the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Figure 2:
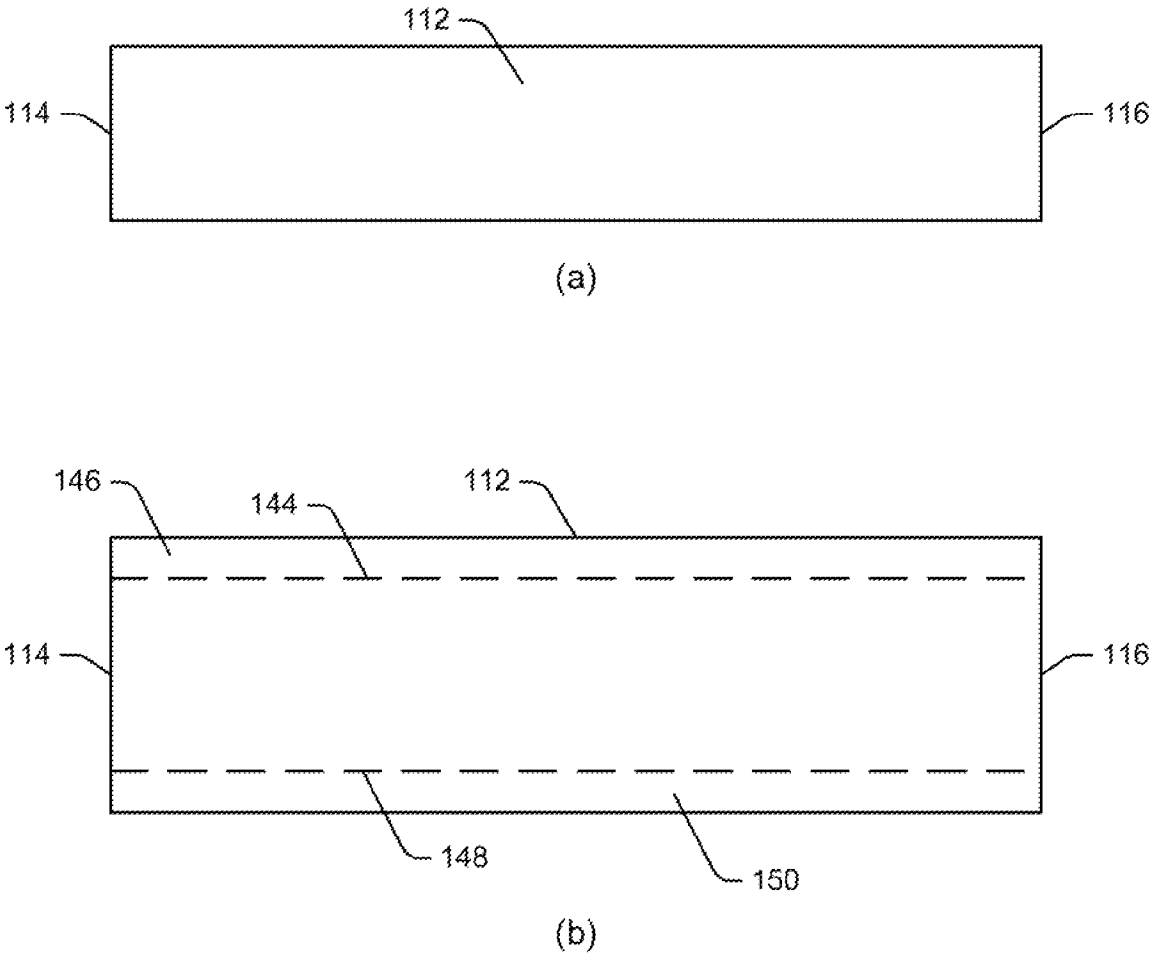
FIG. 2 schematically depicts a portion of a bow label assembly in accordance with one or more embodiments of the disclosure.
Figure 3:
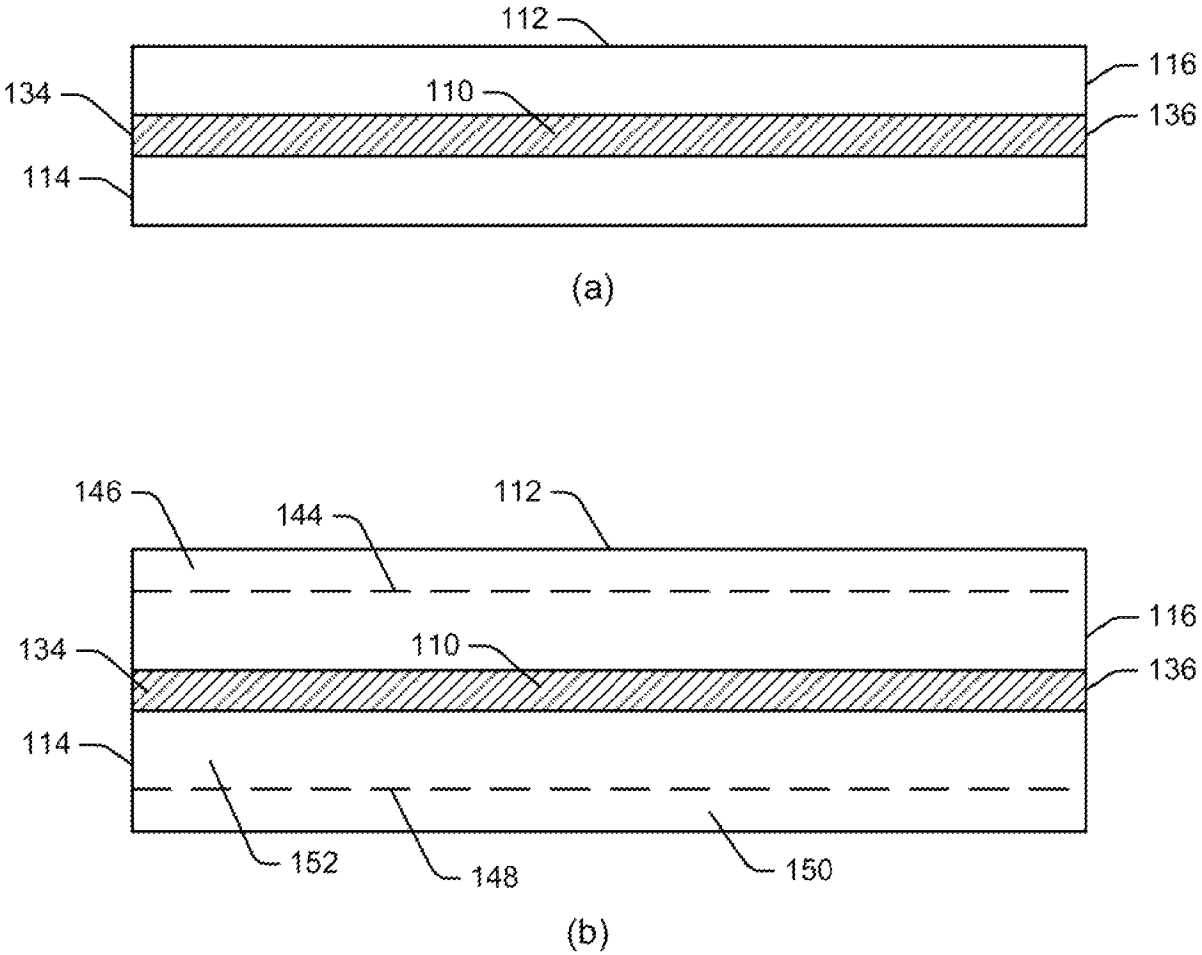
FIG. 3 schematically depicts a portion of a bow label assembly in accordance with one or more embodiments of the disclosure.
Figure 4A:
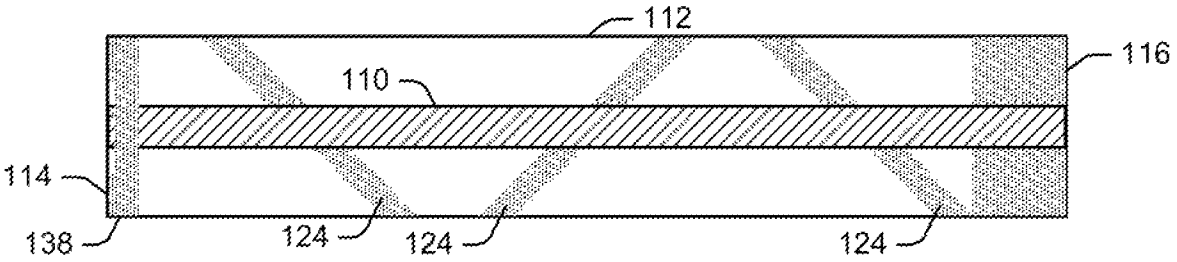
FIG. 4 schematically depicts a portion of a bow label assembly in accordance with one or more embodiments of the disclosure.
Figure 4B:
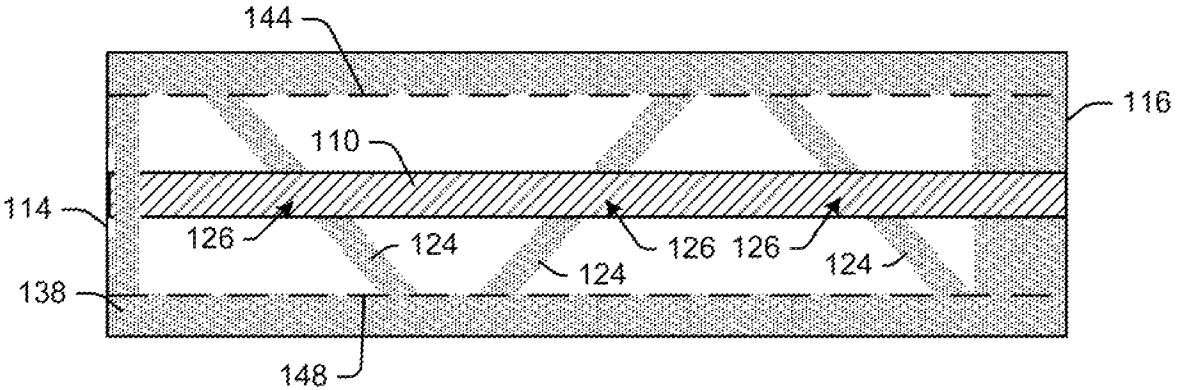
Figure 4C:
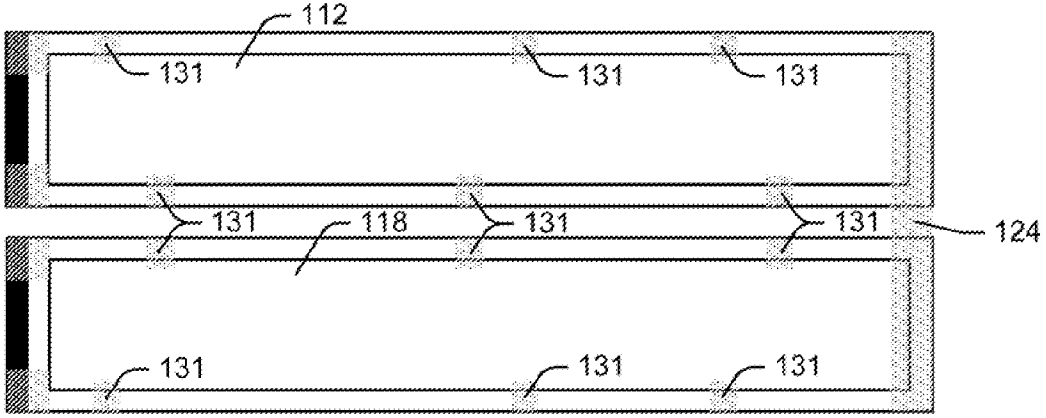
Figure 4D:
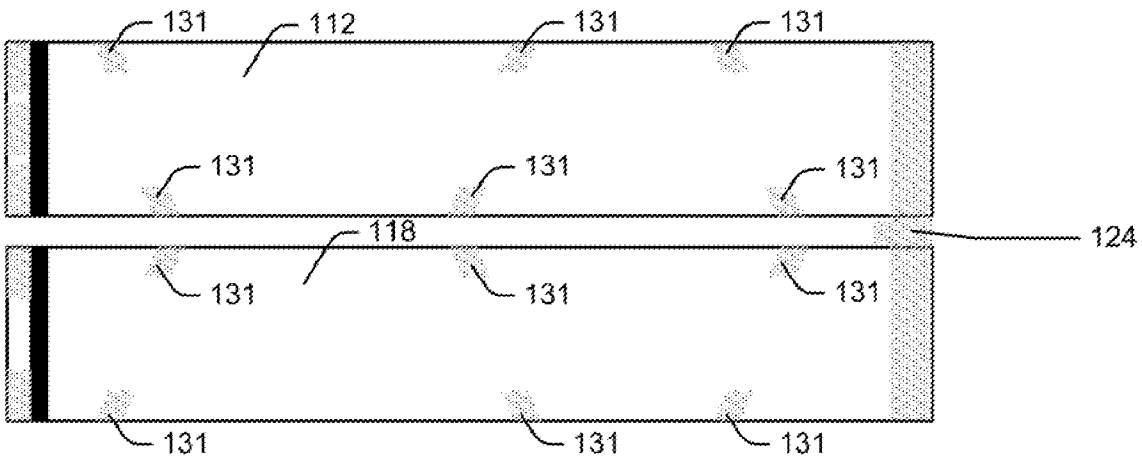
Figure 5:
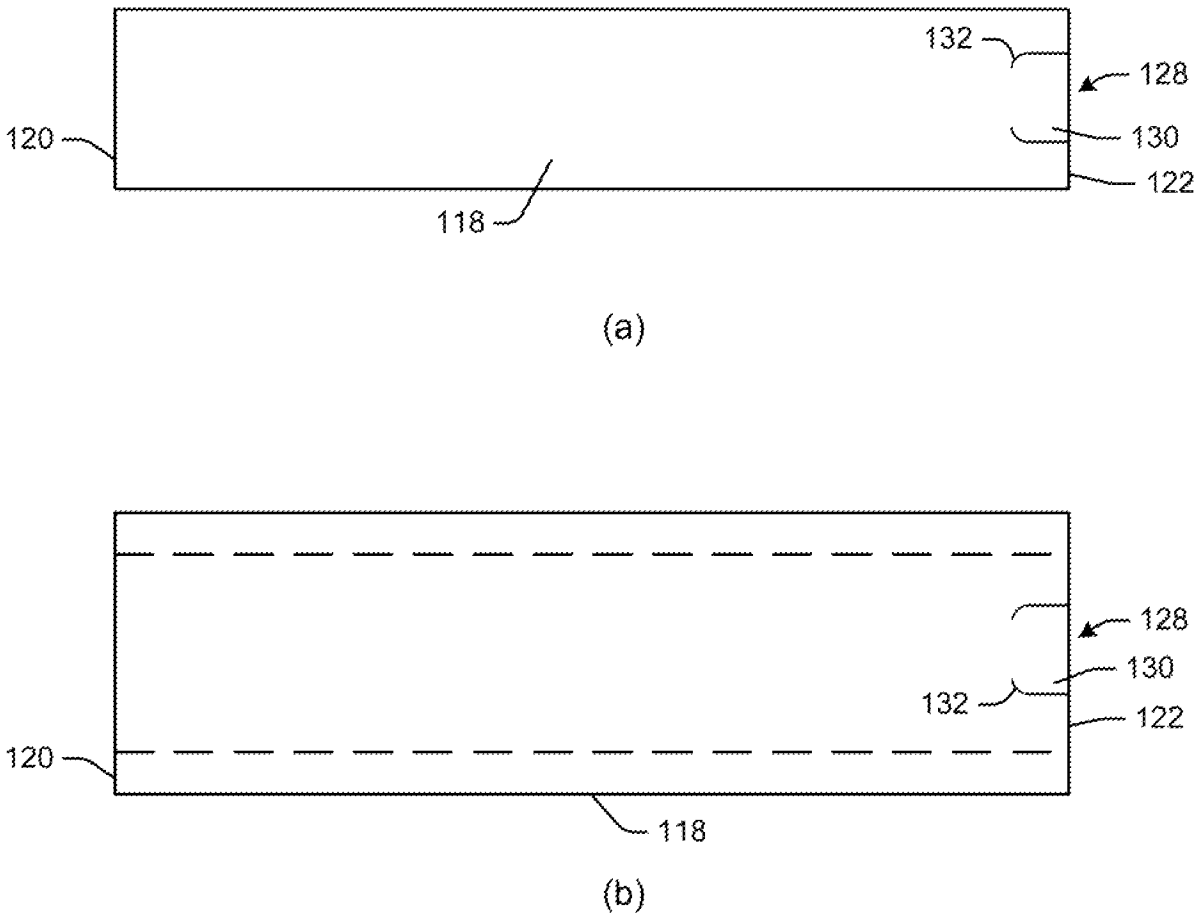
FIG. 5 schematically depicts a portion of a bow label assembly in accordance with one or more embodiments of the disclosure.
Figure 6:
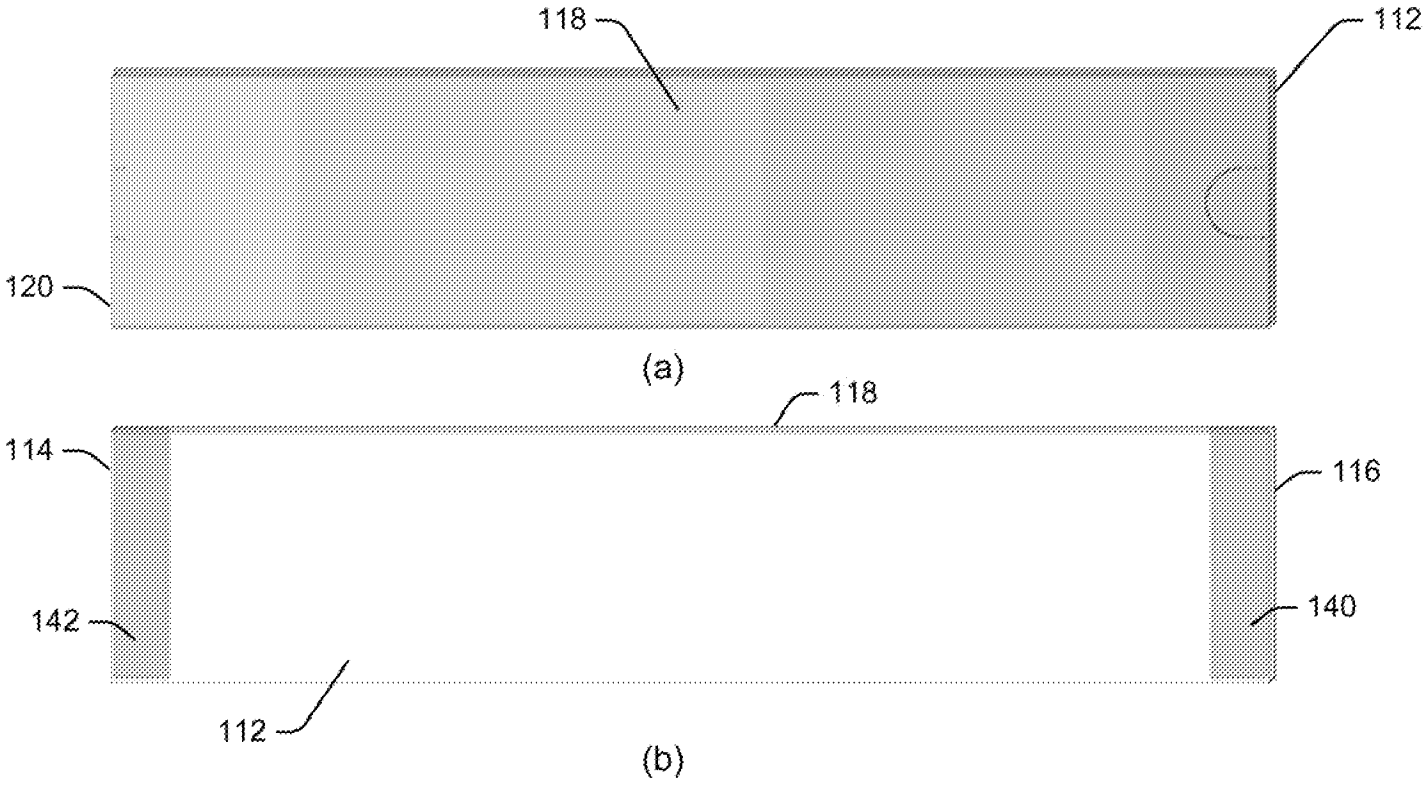
FIG. 6 schematically depicts a portion of a bow label assembly in accordance with one or more embodiments of the disclosure.
Figure 7:
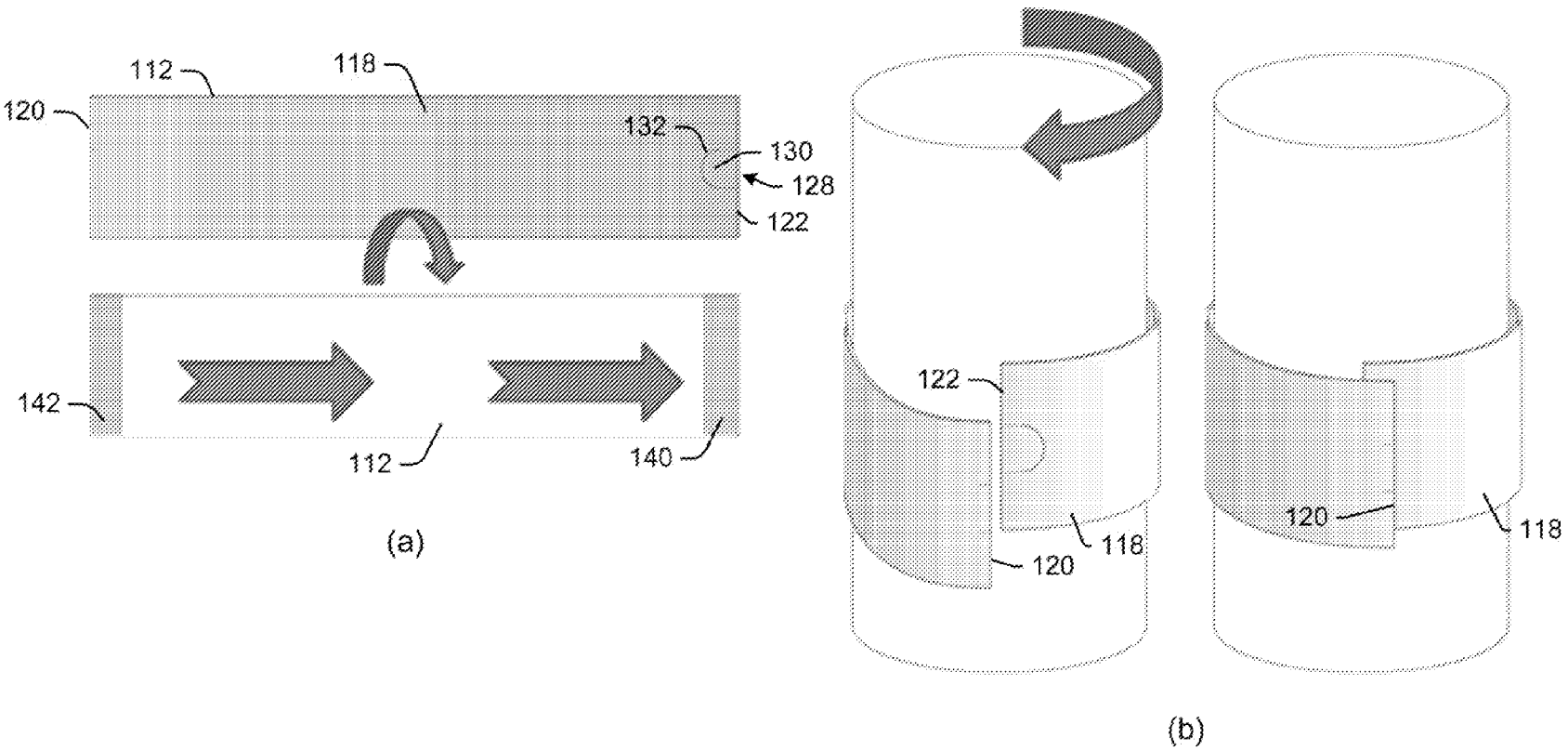
FIG. 7 schematically depicts an example method for a bow label assembly in accordance with one or more embodiments of the disclosure.
Figure 8:
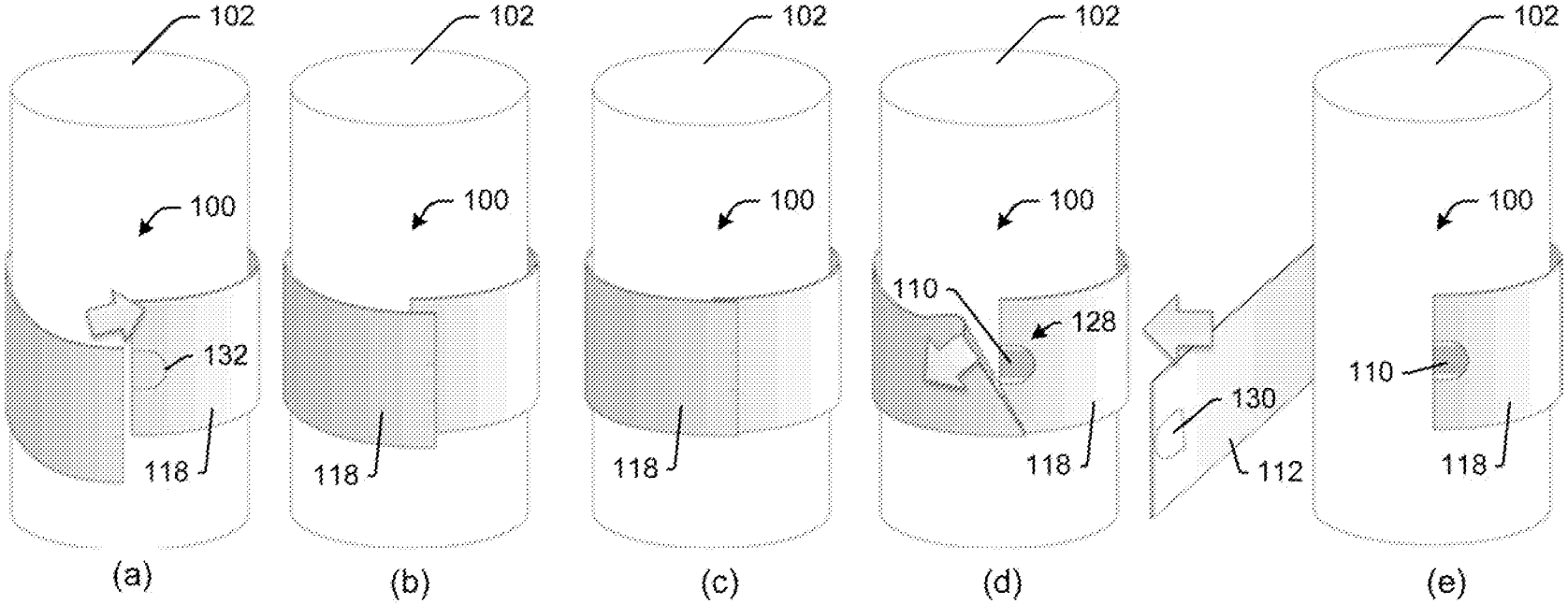
FIG. 8 schematically depicts an example method for a bow label assembly in accordance with one or more embodiments of the disclosure.

FIGS. 1-8 schematically depict one or more example systems and methods for a bow label 100 for a beverage container 102. The beverage container 102 may include a bottle, a can, a jug, or the like. Any container capable of storing, transporting, and/or dispensing a beverage may be used herein. The beverage container 102 may be sized and shaped to enable a user to consume a beverage therefrom (e g, immediate consumption), and/or the beverage container 102 may be configured to transport and dispense a beverage into other containers (e.g., future consumption). The beverage container 102 is depicted as a bottle, although any beverage container may be used herein. In some instances, the beverage container 102 may contain a carbonated beverage, a non-carbonated beverage, water, juice, milk, etc. Any beverage or combination of beverages may be used herein.

In some instances, the bow label 100 may form a label 106 around the beverage container 102. That is, in some configurations, the bow label 100 may be wrapped around the beverage container 102 and may include one or more color schemes or markings viewable by a consumer. The bow label 100 may include one or more indicia, such as trademarks, advertisements, or the like. Any markings may be disposed about the bow label 100, including on the exterior and/or the interior of the bow label 100.

In certain embodiments, the bow label 100 also may form a bow-like shape 104 about the beverage container 102. For example, as described above, the bow label 100 may initially take the form of a typical label 106 that is wrapped around the beverage container 102. The bow label 100, however, may be manipulated by a user 108 to form a bow-like shape 104 about the beverage container 102. The bow-like shape 104 may be attached to the surface of the beverage container 102. For example, the user 108 may partially unwrap a portion of the bow label 100 from the beverage container 102 to expose a pull cord 110. A portion of the bow label 100 may still be attached to the beverage container 102 when the bow label 100 is partially unwrapped from the beverage container 102. The user 108 may then pull on the pull cord 110 to transform the bow label 100 into the bow-like shape 104. Although described as a bow, the pull cord 110 may be pulled to transform the bow label 100 into any decorative shape, text message, image, or the like.

According to an example embodiment, the bow label 100 may include a first sheet 112 (or inner sheet) having a first end 114 and a second end 116. The first sheet 112 may include an elongated body between the first end 114 and the second end 116. In some instances, the first sheet 112 may be generally rectangular. The first sheet 112 may be at least partially attached to the beverage container 102. For example, at least one end of the first sheet 112 (e.g., the second end 116) may be attached to the beverage container 102. In other instances, both ends of the first sheet 112 may be attached to the beverage container 102, with one end being removable (e.g., the first end 114). The bow label 100 also may include a second sheet 118 (or outer sheet) having a first end 120 and a second end 122. The second sheet 118 may include an elongated body between the first end 120 and the second end 122. In some instances, the second sheet 118 may be generally rectangular. The first sheet 112 and the second sheet 118 may be any size or shape.

The second sheet 118 may be at least partially attached to the first sheet 112. The first sheet 112 and the second sheet 118 may include a first configuration and a second configuration. In addition, the bow label 100 may include a pull cord 110 disposed between and at least partially attached to the first end 114 of the first sheet 112 and the first end 120 of the second sheet 118. In this manner, movement of the pull cord 110 may move the first sheet 112 and the second sheet 118 between the first configuration and the second configuration. That is, movement of the pull cord 110 may draw the first end 114 of the first sheet 112 and the first end 120 of the second sheet 118 (which may be partially unwrapped from the beverage container 102) towards the second end 116 of the first sheet 112 and the second end 122 of the second sheet 118 (which may be attached to the beverage container 102).

In some instances, the second configuration may include the bow-like shape 104. For example, as the first end 114 of the first sheet 112 and the first end 120 of the second sheet 118 are drawn towards the second end 116 of the first sheet 112 and the second end 122 of the second sheet 118, the first sheet 112 and the second sheet 118 may fold together to form the bow-like shape 104. The second configuration may include a number of folds to form the bow-like shape 104. Certain embodiments may include differing numbers of folds and/or fold patterns to vary the shape, message, or image of the bow.

The first sheet 112 may be at least partially attached to the second sheet 118 by one or more adhesive strips 124. The one or more adhesive strips 124 may be arranged in a pattern to form the bow-like shape 104 in the second configuration. For example, the first sheet 112 and the second sheet 118 may be adhered together by the one or more adhesive strips 124 and folded about the one or more adhesive strips 124 to form the bow-like shape 104 in the second configuration when the pull cord 110 is pulled. That is, the one or more adhesive strips 124 may define the number of folds and/or the fold pattern as the first end 114 of the first sheet 112 and the first end 120 of the second sheet 118 are drawn towards the second end 116 of the first sheet 112 and the second end 122 of the second sheet 118.

In one example embodiment, the one or more adhesive strips 124 may be arranged in opposing angles relative to one another. In this manner, as the first end 114 of the first sheet 112 and the first end 120 of the second sheet 118 are drawn towards the second end 116 of the first sheet 112 and the second end 122 of the second sheet 118, the first sheet 112 and the second sheet 118 may fold at an angle about the one or more adhesive strips 124 to form the bow-like shape 104. The angle of the one or more adhesive strips 124 may alternate to form the bow-like shape 104. To enable the pull cord 110 to be pulled, the one or more adhesive strips 124 may include a channel 126 for the pull cord 110 to pass through.

In some instances, instead of or in addition to the adhesive strips 124, the first sheet 112 may be at least partially attached to the second sheet 118 by thermosealing or other attachment means. Any glue, adhesive, heat seal, or the like may be used. For example, the first sheet 112 may be thermosealed to the second sheet 118 in a pattern. In some instances, the first sheet 112 may be attached to the second sheet 118 at various points 131 along the length of the first sheet 112 and the second sheet 118. The arrangement of the sealing points 131 facilitates the angled folding of the bow label 100 as the first end 114 of the first sheet 112 and the first end 120 of the second sheet 118 are drawn towards the second end 116 of the first sheet 112 and the second end 122 of the second sheet 118. The location and distance between the sealing points 131 may be varied to alter the configuration of the bow-like shape 104. The sealing points 131 may be spaced apart to enable the passage of the pull cord 110. In some instances, the sealing points 131 may be angled to further facilitate folding of the bow label 100.

The adhesive pattern, the thermosealing pattern, or a combination thereof may be varied to alter the configuration of the bow-like shape 104. For example, one or more adhesive strips may be combined with one or more thermosealed portions to adhere the first sheet 112 to the second sheet 118. In some instances, an adhesive strip (which may be double sided) may be used to attach the pull cord 110 to the first sheet 112 and the second sheet 118. One or more sealing points 131 may be used to attached the first sheet 112 to the second sheet 118 at various points along the length of the first sheet 112 and the second sheet 118. Any number of attachment arrangements may be used herein. That is, the means of attachment (e.g., glue or the like) and the pattern of the attachment between the first sheet 112 and the second sheet 118 may be varied.

In certain embodiments, the bow label 100 may include an access tab 128 disposed about the second end 122 of the second sheet 118. The access tab 128 may provide access to the pull cord 110. That is, the access tab 128 may provide access to at least one end of the pull cord 110. In some instances, the access tab 128 may include a removable flap 130 or the like. For example, the second end 122 of the second sheet 118 may include one or more perforations 132 that may enable the removable flap 130 to be removed from the second sheet 118 (or folded out-of-the-way) to expose at least a portion of the pull cord 110.

The pull cord 110 may include a first end 134 and a second end 136. The first end 134 of the pull cord 110 may be attached to the first end 114 of the first sheet 112 and the first end 120 of the second sheet 118 by an adhesive strip 138 or the like. The pull cord 110 may pass through the channels 126 in the one or more adhesive strips 124. The second end 136 of the pull cord 10 may be accessible from the access tab 128. The second end 136 of the pull cord 110 may not be attached to the first sheet 112 or the second sheet 118. In this manner, the second end 136 of the pull cord 110 may be pulled to draw the first end 114 of the first sheet 112 and the first end 120 of the second sheet 118 towards the second end 116 of the first sheet 112 and the second end 122 of the second sheet 118. The pulling of the pull cord 110 may move the first sheet 112 and the second sheet 118 from the first configuration to the second configuration (e.g., the bow-like shape 104).

In some instances, the first sheet 112 and the second sheet 118 may be wrapped around the beverage container 102 in the first configuration. For example, the second end 116 of the first sheet 112 may be at least partially attached to the beverage container 102 with an adhesive 140 or the like. In addition, the first end 114 of the first sheet 112 may be wrapped around the beverage container 102 and at least partially attached to the second end 122 of the second sheet 118 by an adhesive 142 or the like. In this manner, the bow label 100 may be wrapped around the beverage container 102 in the first configuration. In some instances, the first end 114 of the first sheet 112 may be detached from the second end 122 of the second sheet 118 to expose the access tab 128 and the second end 136 of the pull cord 110. The first configuration may include any arrangement before the pull cord 110 is pulled and the bow-like shape 104 is formed. That is, the first configuration may include a partially unwrapped arrangement where the first end 114 of the first sheet 112 is detached from the second end 122 of the second sheet 118.

In certain embodiments, a first strip of perforations 144 may be disposed about the first sheet 112 and the second sheet 118. The first strip of perforations 144 may define a first portion 146 of the first sheet 112 that is at least partially attached to the beverage container 102. Likewise, a second strip of perforations 148 may be disposed about the first sheet 112 and the second sheet 118. The second strip of perforations 148 may define a second portion 150 of the first sheet 112 that is at least partially attached to the beverage container 102. The first sheet 112 and the second sheet 118 may be torn about the first strip of perforations 144 and/or the second strip of perforations 148 to form a middle portion 152 that may be folded into the bow-like shape 104. That is, the first portion 146 and the second portion 150 may be attached to the beverage container 102, while the middle portion 152 may be attached to the beverage container 102 only at its end 116. In some instances, the first strip of perforations 144 and/or the second strip of perforations 148 may be omitted. For example, the bow label 100 may include no strips of perforations, both the first strip of perforations 144 and the second strip of perforations 148, only the first strip of perforations 144, or only the second strip of perforations 148.

In use, a user 108 may remove the first end 114 of the first sheet 112 from the second end 122 of the second sheet 118 to unwrap the bow label 100 from around the beverage container 102. In some instances, if present, the first strip of perforations 144 and/or the second strip of perforations 148 may be torn to form the middle portion 152 of the bow label 100. In unwrapping the bow label 100, the access tab 128 may be opened and a portion of the pull cord 110 exposed. The user 108 may then pull the second end 136 of the pull cord 110 to draw the first end 114 of the first sheet 112 and the first end 120 of the second sheet 118 towards the second end 116 of the first sheet 112 and the second end 122 of the second sheet 118, which may fold the first sheet 112 and the second sheet 118 (or the middle portion 152 of the first sheet 112 and the second sheet 118) about the one or more adhesive strips 124 to form the bow-like shape 104.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described.

For example, in another embodiment of the present disclosure, elements of the printed artwork disclosed herein may also be in the form of a heart, written or text message, contour bottle, hand, flowers, or any other similar shape or message. In a heart, contour bottle, hand, or flower shape or written message, for example, a label may be placed in such a way that when the label is pulled and made into a form, (e.g., into a heart, contour bottle, hand, or flower shape (like a bow)), the elements of the printed design may come together to reveal or create a shape, message, or form, such as a heart, contour bottle, flower, hand, or written message.

Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that the features, elements, and/or steps are in any way required for one or more embodiments.

That which is claimed is:

1. A bow label for a beverage container, the bow label comprising:

a first sheet at least partially attached to the beverage container;

a second sheet at least partially attached to the first sheet, wherein the first sheet and the second sheet comprise a first configuration and a second configuration; and a pull cord disposed between and at least partially attached to the first sheet and the second sheet, wherein movement of the pull cord moves the first sheet and the second sheet between the first configuration and the second configuration, wherein the first sheet and the second sheet are wrapped around the beverage container in the first configuration, wherein the second configuration comprises a bow-like shape.

2. The bow label of claim 1, further comprising an access tab disposed about the second sheet for accessing the pull cord.

3. The bow label of claim 2, wherein the access tab comprises a removable flap.

4. The bow label of claim 1, further comprising a first strip of perforations disposed about the first sheet and the second sheet.

5. The bow label of claim 1, further comprising a second strip of perforations disposed about the first sheet and the second sheet.

6. The bow label of claim 1, where the bow-like shape is configured into a heart, flower, written message, contour bottle or hand shape.

7. The bow label of claim 1, wherein the first sheet is at least partially attached to the second sheet by one or more adhesive strips.

8. The bow label of claim 7, wherein the one or more adhesive strips are arranged in a pattern to form the bow-like shape in the second configuration.

9. The bow label of claim 7, wherein the first sheet and the second sheet fold about the one or more adhesive strips to form the bow-like shape in the second configuration.

10. A bow label for a beverage container, the bow label comprising:

a first sheet comprising a first end and a second end, wherein the first sheet is at least partially attached to the beverage container;

a second sheet comprising a first end and a second end, wherein the second sheet is at least partially attached to the first sheet, wherein the first sheet and the second sheet comprise a first configuration and a second configuration; and a pull cord disposed between and at least partially attached to the first end of the first sheet and the first end of the second sheet, wherein movement of the pull cord moves the first sheet and the second sheet between the first configuration and the second configuration, wherein the second configuration comprises a bow-like shape.

11. A method for forming a bow on a beverage container, the method comprising:

removing a first end of a label wrapped about the beverage container to expose a pull cord;

removing an access tab for accessing the pull cord; and pulling the pull cord to deform the label into a bow-like shape.

12. The method of claim 11, wherein the access tab comprises a removable flap.

13. The method of claim 11, further comprising wrapping the label around the beverage container.

14. The method of claim 11, further comprising attaching the label to the beverage container.

15. The method of claim 14, further comprising attaching a first end of the label to a second end of the label.

16. The method of claim 11, further comprising tearing a first strip of perforations.

17. The method of claim 11, further comprising tearing a second strip of perforations.

18. The method of claim 11, further comprising forming the label with one or more adhesive strips.

19. The method of claim 18, further comprising folding the label about the one or more adhesive strips to form the bow-like shape.

* * * * *